US009200868B2

(12) United States Patent
Monteil et al.

(10) Patent No.: US 9,200,868 B2
(45) Date of Patent: Dec. 1, 2015

(54) VESSEL OF THE TYPE COMPRISING AT LEAST ONE SHAFT FOR RECEIVING AT LEAST ONE MISSILE-LAUNCHING CONTAINER

(75) Inventors: Dominique Monteil, Ruelle (FR); Didier Seguinot, Mornac (FR); Marie Anne Armbrust, Angouleme (FR); Herve Bruneau, Champniers (FR)

(73) Assignee: DCNS, Paris (FR)

( * ) Notice: Subject to any disclaimer, the term of this patent is extended or adjusted under 35 U.S.C. 154(b) by 17 days.

(21) Appl. No.: 13/824,737

(22) PCT Filed: May 9, 2012

(86) PCT No.: PCT/EP2012/058529

§ 371 (c)(1),
(2), (4) Date: May 17, 2013

(87) PCT Pub. No.: WO2012/152826

PCT Pub. Date: Nov. 15, 2012

(65) Prior Publication Data

US 2014/0060296 A1 Mar. 6, 2014

(30) Foreign Application Priority Data

May 11, 2011 (FR) ..... 11 54061

(51) Int. Cl.
*F41F 3/042* (2006.01)
*B63G 3/04* (2006.01)

(52) U.S. Cl.
CPC .. *F41F 3/042* (2013.01); *B63G 3/04* (2013.01)

(58) Field of Classification Search
CPC ..... F41F 3/00; F41F 3/052; F41F 3/042; F41F 3/073; B63G 3/04
USPC ..... 89/1.801–1.819
See application file for complete search history.

(56) References Cited

U.S. PATENT DOCUMENTS

| | | | | | |
|---|---|---|---|---|---|
| 2,064,751 | A | * | 12/1936 | Hussman | 248/544 |
| 3,468,213 | A | * | 9/1969 | Hersh et al. | 89/1.8 |
| 3,794,277 | A | * | 2/1974 | Smedley et al. | 248/548 |
| 3,967,906 | A | * | 7/1976 | Strizki | 403/2 |
| 4,665,792 | A | * | 5/1987 | Gassler et al. | 89/1.816 |
| 4,783,038 | A | * | 11/1988 | Gilbert et al. | 248/570 |
| 4,878,416 | A | * | 11/1989 | Orquera et al. | 89/1.81 |
| 5,062,507 | A | * | 11/1991 | Roche | 188/378 |
| 5,115,711 | A | * | 5/1992 | Bushagour et al. | 89/1.816 |
| 5,169,110 | A | * | 12/1992 | Snaith et al. | 248/570 |
| 5,529,276 | A | * | 6/1996 | Szablya | 248/548 |

(Continued)

FOREIGN PATENT DOCUMENTS

| | | | |
|---|---|---|---|
| EP | 0284777 | A1 | 10/1988 |
| EP | 0304345 | A1 | 2/1989 |

(Continued)

*Primary Examiner* — Joshua Freeman
(74) *Attorney, Agent, or Firm* — Knobbe Martens Olson & Bear LLP

(57) ABSTRACT

Vessel of the type comprising at least one shaft for receiving at least one missile-launching container (1), characterized in that the launching container (1) is received in the shaft with controlled lateral and axial clearance; the upper portion of the side wall of the container is provided with means for centring/guiding same in the shaft; and the lower end includes a container-bearing base (8) associated with a supporting base (9) of the vessel by means of shock-filtering set-point damping means (10).

18 Claims, 3 Drawing Sheets

(56) References Cited

U.S. PATENT DOCUMENTS

| | | | | |
|---|---|---|---|---|
| 5,549,285 | A | 8/1996 | Collins | |
| 5,897,093 | A * | 4/1999 | Le Derf | 248/628 |
| 6,299,150 | B1 * | 10/2001 | Allen et al. | 267/178 |
| 6,406,011 | B1 * | 6/2002 | Kosar et al. | 267/148 |
| 6,540,198 | B2 * | 4/2003 | Carter et al. | 248/638 |
| 2009/0126556 | A1 * | 5/2009 | Skurdal et al. | 89/1.817 |
| 2011/0017561 | A1 * | 1/2011 | Tanaka | 188/378 |
| 2012/0104219 | A1 * | 5/2012 | Kalms et al. | 248/560 |
| 2012/0152090 | A1 * | 6/2012 | Skurdal et al. | 89/1.8 |

FOREIGN PATENT DOCUMENTS

| | | | |
|---|---|---|---|
| EP | 0553633 | A1 | 8/1993 |
| FR | 2559863 | A1 | 8/1985 |
| FR | 2827034 | A1 | 1/2003 |
| GB | 2160825 | A | 1/1986 |
| JP | 2000-074132 | A | 3/2000 |
| JP | 2006-266074 | A | 10/2006 |
| JP | 2011-042974 | A | 3/2011 |

* cited by examiner

VESSEL OF THE TYPE COMPRISING AT LEAST ONE SHAFT FOR RECEIVING AT LEAST ONE MISSILE-LAUNCHING CONTAINER

CROSS-REFERENCE TO RELATED APPLICATIONS

This application is the U.S. National Phase under 35. U.S.C. §371 of International Application PCT/EP2012/058529, filed May 9, 2012 which claims priority to French Patent Application No. 11 54061, filed May 11, 2011. The disclosures of the above-described application are hereby incorporated by reference in their entirety.

This invention concerns a vessel comprising at least one shaft for receiving at least one missile-launching container.

Vessels equipped with such containers, chosen, e.g., from the range of containers known under the brand name SYLVER® of the applicant, are known to the prior art.

In known-art systems, the/each launching container is received in one or more corresponding shafts of the ship such that their upper part is flush with the ship's bridge and their lower part is rigidly affixed to the bottom of the shaft, and thus to the structure of the ship.

However, this has a number of disadvantages, in particular with regard to the protection of the missiles, or, generally, the munitions in the/each container, as the shocks experienced by the ship are fully transmitted to the munitions stored in the containers.

This is the case, e.g., in the event of underwater explosions that may result in shocks of several dozen g in the ship's structure.

Generally, a set-point resilient support, in particular for suspending devices or material on ships is known from the prior art from document FR A 2 559 863.

Such a support includes a U-shaped support element in resilient material, one branch of which is affixed to the support structure such as the ship and the other supports the device or material, whereby both branches are rigidified by a spacer extending between them, formed by a fracturable rod on a plane substantially parallel to the branches of the U and connected to both branches, with the connection to at least one of the branches being provided by a second fracturable element in the direction of the rod.

However, such a support is not applicable to this applications due to the specific constraints noted above.

The aim of this invention is thus to solve these problems.

To this end, the invention concerns a vessel of the type comprising at least one shaft for receiving at least one missile-launching container, characterised in that the launching container is received in the shaft with controlled lateral and axial clearance; the upper portion of the side wall of the container is provided with means for centring/guiding same in the shaft; and the lower end includes a container-bearing base associated with a supporting base of the vessel by means of shock-filtering set-point damping means.

According to other characteristics, individually or in combination:

the shaft and the container have vertical axes, the guidance/centring means comprise stops in shock-absorbing material, the set-point damping means comprise damping organs connected to pretensioned set-point break strips that are mounted between the two bases, the damping means comprise at least one damping assembly with metal windings, the damping means comprise at least two damping assemblies with metal windings arranged symmetrically on either side of the container, the metal windings are in the form of at least one coil spring organ arranged lying flat between the bases, with its opposite edges engaged in openings for corresponding connection lugs of the bases, each break strip includes two portions connected by a frangible pin, each end of which is connected to a base, the portions of the strips include a male portion with one end suited to engage with a screed on one end of a corresponding female portion of the strip, whereby the frangible pin extends transversely into the screed of the female portion and through the male portion of the strip, at least one end of each break strip is threaded and engaged with an opening of a bracket on the corresponding base, and operates in tandem with a corresponding nut to allow for the pretensioned mounting of the strip between the bases, both ends of each strip are threaded, and each is suited to engage with an opening in a bracket and to operate in tandem with a corresponding nut, each nut has a spherical support range suited to operate in tandem with an additional support surface of the corresponding bracket, the set-point damping means include at least two related set-point break strips that are mounted head-to-tail between the basis, the set-point break strips are inclined in the direction of the axis of the container, the set-point damping means comprise at least two sets of two strips arranged symmetrically on either side of the container, and the container has a rectangular section, and both damping assemblies with metal windings are arranged symmetrically on two sides of the container, whilst the two sets of two strips are symmetrically arranged on the two other sides of the container.

The invention will be better understood based on the following description, provided by way of example only, referring to the attached drawings, in which.

Figure 1:
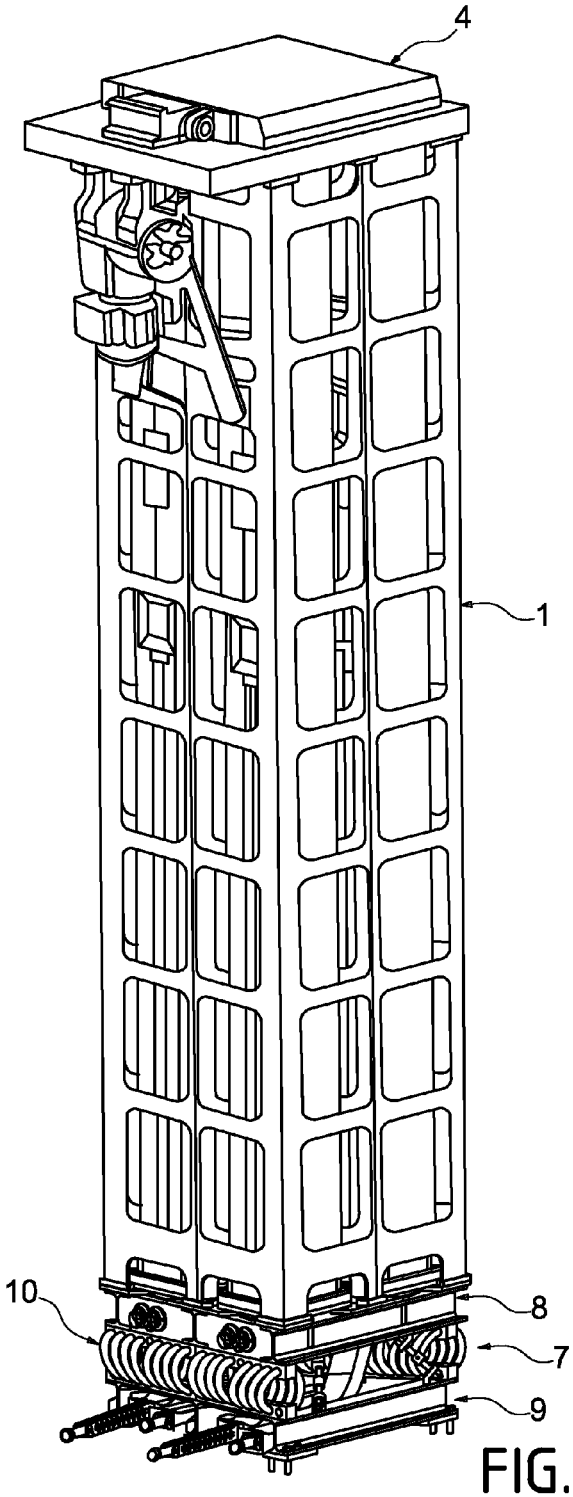
FIG. 1 is a perspective view of a missile-launching container equipped with damping means.
Figure 3:
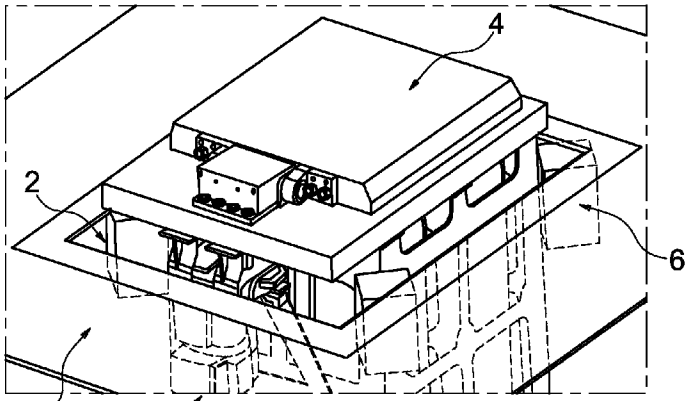
FIGS. 2 and 3 are partial perspective views of the upper part of the container positioned in a receiving shaft of a vessel.
Figure 2:
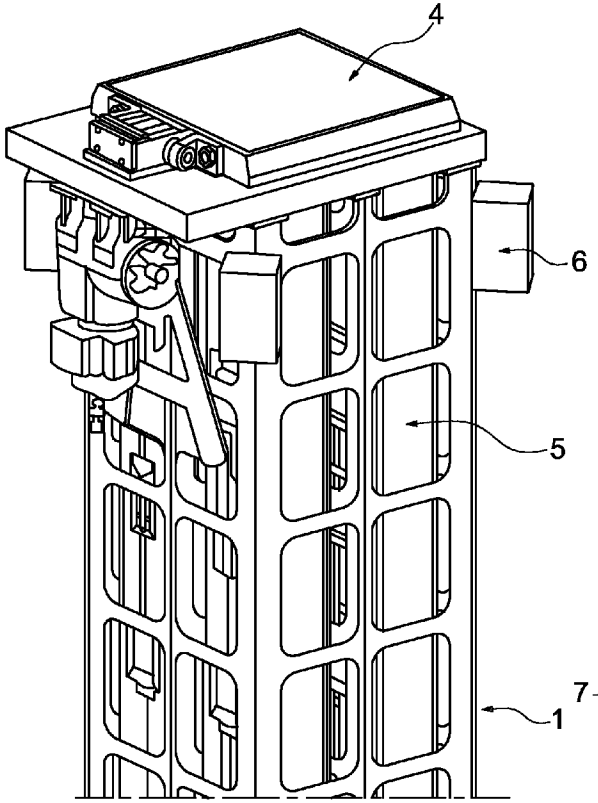

FIGS. 1 to 3 show a missile-launching container designated by general reference 1 in these figures, received by a corresponding receiving shaft 2 of a vessel 3.

In the exemplary embodiment shown, the container and the shaft have vertical axes, whereby the upper part of the container is, e.g., flush with the bridge of the ship and equipped with a shutter designated by general reference 4, which can be retracted when a missile is fired.

As is also shown, classically, these missiles are received, e.g., in the container 1 with their holes or protection camps, one of which is designated, e.g., by general reference 5.

In fact, as shown in these drawings, the launching container 1 is received with a controlled axial and lateral deviation in the shaft, and the lateral wall of the container is equipped on its upper part with means of centring/guidance in the shaft, consisting, e.g., of stops in shock-absorbing material, one of which can be seen in the drawings and is designated by general reference 6.

These stops in shock-absorbing material are then, e.g., arranged between the container and the corresponding wall of the shaft to centre and guide, e.g., the top part of the container in the shaft.

On its lower part, the container is connected with and rests on damping means designated by general reference 7 in FIG. 1, including a load-bearing base designated by general reference 8, connected with a support base of the vessel designated by general reference 9, via shock-filtering set-point damping means designated by general reference 10.

Figure 4:
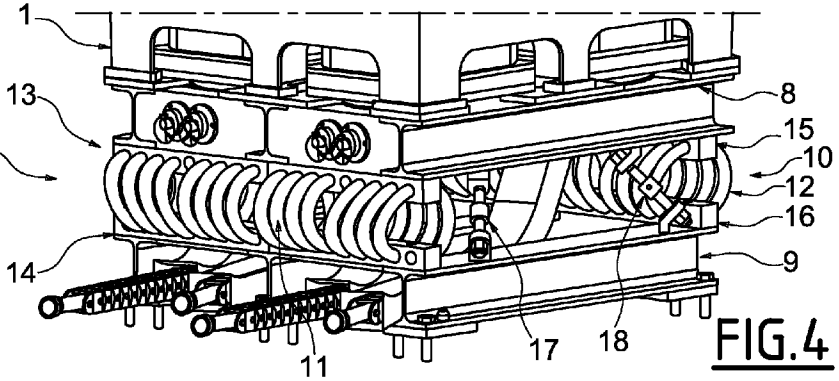
FIG. 4 is an enlarged perspective view of the damping means with which the lower part of the container shown in the foregoing figures is equipped.
Figure 5:
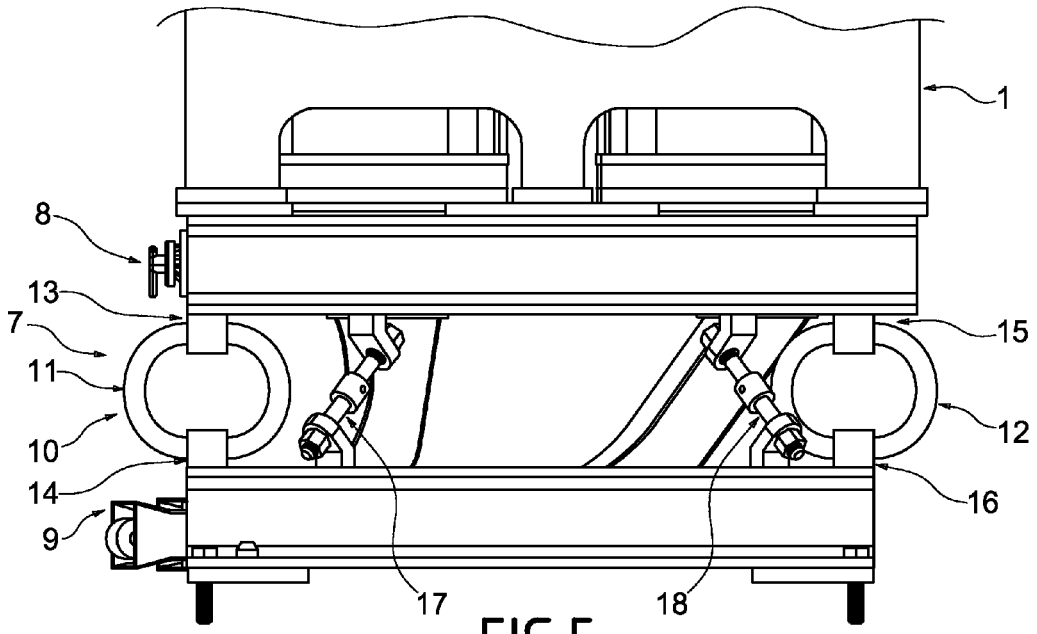
FIG. 5 is a side view of the damping means.
Figure 6:
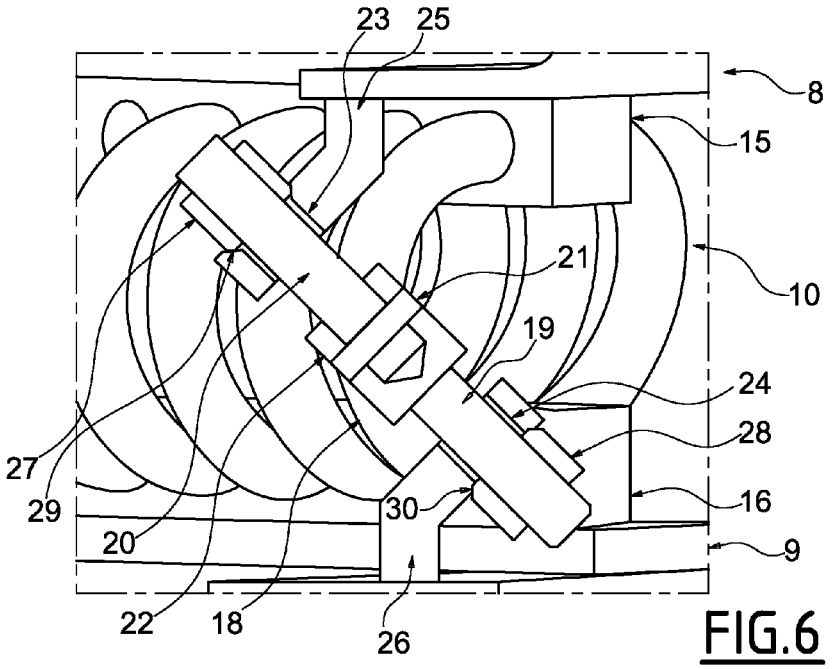
FIG. 6 is a detail view of a set-point breaking strip integrated into the damping means.

These damping means are described in greater detail in FIGS. 4, 5, and 6.

As shown, these damping means comprise at least one damping assembly with metal windings, and, in the example shown, at least two damping assemblies with metal windings, arranged symmetrically on either side of the container and designated by general references 1 and 12 in these drawings.

In fact, the damping assemblies with metal windings are in the form of at least one coil spring organ arranged lying flat between the bases, with its opposite edges engaged in openings for corresponding connection lugs of the bases, e.g., lugs 13, 14, 15, and 16 shown in these drawings.

These damping means also include pretensioned set-point breaking pins mounted between the two bases, two of which, 17, 18 respectively, are shown in these drawings.

One of these breaking strips 18 is shown in greater detail in FIG. 6.

This break strip includes two portions, 19, 20, connected by a frangible pin 21, each end of which is connected to a base.

Thus, for example, each strip includes a male portion, designated by general reference 20, with one end suited to engage with a screed 22 on one end of a corresponding female portion 19 of the strip, whereby the frangible pin 21 extends transversely into the screed of the female portion and through the male portion of the strip 20.

As also shown in FIG. 6, at least one end of each strip 18 is threaded and engaged with an opening 23, 24 of a bracket 25, 26 on the corresponding base 8, 9, and operates in tandem with a corresponding nut 27, 28 to allow for the pretensioned mounting of the strip between the bases.

In the exemplary embodiment shown, both ends of each strip are threaded, and each is suited to engage with an opening in a bracket and to operate in tandem with a corresponding nut.

It will further be noted that each nut has a spherical support range 29, 30 suited to operate in tandem with an additional support surface of the corresponding bracket 25, 26.

The set-point damping means may include several related set-point break strips.

Thus, for example, at least two related set-point break strips, mounted head-to-tail between the bases, may be provided.

These are advantageously inclined in the direction of the axis of the container 1, as seen in the drawings.

In fact, and according to the embodiment shown, the damping means may include two sets of two strips arranged symmetrically on either side of the container.

Thus, in the example shown, the container has a rectangular section, and two damping assemblies with metal windings are arranged symmetrically on two sides of the container, whilst two sets of two strips are symmetrically arranged on the two other sides of the container.

Such a structure allows, based, e.g., on an input shock of 30 g vertically or 15 g transversely, for absorption of the shock energy to obtain a maximum of 10 g on the on-board munitions, with a munitions load variable from 1-4 munitions, i.e., a range of the mass of munitions of 150-600 kg, a dissymetrical munitions load, or taking into account the force related to the launching of a missile (35 KN, dissymetrical, to the launcher), knowing that, under normal operating conditions (initial firing of the missile, platform movement, etc.) the axes of the launching cells must maintain positional fidelity on the order of 1 mrad.

Thus, a damping assembly with a tripping threshold is integrated into the fixation of the container/launcher on the vessel.

In normal operating conditions, the launcher maintains its rigidity characteristics to meet the requirements of alignment of the missiles, and in case of shocks related, e.g., to underwater explosions, the dampers are tripped at the calibrated values.

This limits accelerations of the munitions in order to preserve them.

As noted above, the strips are mounted with pretension at the level of the damping means.

In these conditions, the strips are extended, and withstand the forces generated by the crushing of the shock absorbers.

In the event of a shock related, e.g., to an underwater explosion, the upward activation of the launcher causes additional crushing of the windings.

In this moment, the strips are no longer under tension. It is the kickback when the strips return to their place that the frangible strips break.

Then, the shock absorbers take over to protection the munitions.

In the event of a transverse shock, the forces applied to the launcher cause coupling at the level of the strips. The two strips, operating in compression, are broken upon the first crash pulse, and the two others are broken upon the first kickback.

The shock absorbers then take over to filter the accelerations and preserve the munitions.

This principle allows the accelerations of the vertical shock to be divided by two, i.e., 15 g.

It should be noted that, following a shock from an underwater explosion, when the strips are broken, it is possible to reconfigure the installation so that the launcher returns to nominal capacity by simply replacing the strips.

It thus assumed during the calculations for the sizing of the launcher that the damping means with a tripping threshold will limit the constraints.

This allows not only for general reduction of the mechanical resistance of the launcher, but also for a reduction of the forces on the vessel and munitions interfaces.

Of course, other embodiments are also possible.

The invention claimed is:

1. Vessel comprising at least one shaft for receiving at least one missile-launching container, wherein the launching container is received in the shaft with controlled lateral and axial clearance; the-an upper portion of a side wall of the container is provided with means for centering/guiding same-in the shaft; and a lower end of the container includes a container-bearing base associated with a supporting base of the vessel by means of shock-filtering set-point damping means, the shock-filtering set-point damping means comprising damping organs connected with pretensioned set-point break strips that are mounted between the bases; wherein at least one end of each break strip is threaded and engaged with an opening of a bracket on one of the bases and operates in tandem with a corresponding nut to allow for the pretensioned mounting of the strip between the bases.

2. Vessel according to claim 1, wherein the shaft and the container have vertical axes.

3. Vessel according to claim 2, wherein the guiding/centring means comprise stops in shock-absorbing material.

4. Vessel according to claim 1, wherein the guiding/centring means comprise stops in shock-absorbing material.

5. Vessel according to claim 1, wherein the damping organs comprise at least one damping assembly with metal windings.

6. Vessel according to claim 5, wherein the damping organs comprise at least two damping assemblies with metallic windings arranged symmetrically on either side of the container.

7. Vessel according to claim 5, wherein the metal windings are in the form of at least one coil spring organ arranged lying flat between the bases, with its opposite edges engaged in openings for corresponding connection lugs of the bases.

8. Vessel according to claim 1, wherein each break strip includes two portions of strip connected by a frangible pin, each end of which is connected to one of the bases.

9. Vessel according to claim 8, wherein the portions of the strips include a male portion of strip with one end suited to engage with a screed on one end of a corresponding female portion of the strip, whereby the frangible pin extends transversely into the screed of the female portion of strip and through the male portion of strip.

10. Vessel according to claim 1, wherein both ends of each strip are threaded, and each is suited to engage with an opening in a bracket and to operate in tandem with a corresponding nut.

11. Vessel according to claim 10, wherein each nut has a spherical support range suited to operate in tandem with an additional support surface of the corresponding bracket.

12. Vessel according to claim 1, wherein the said corresponding nut has a spherical support range suited to operate in tandem with an additional support surface of the corresponding bracket.

13. Vessel according to claim 1, wherein the set-point damping means include at least two related set-point break strips that are mounted head-to-tail between the bases.

14. Vessel according to claim 13, wherein the set-point damping means include at least two sets of two strips, arranged symmetrically on either side of the container.

15. Vessel according to claim 14, wherein the container has a rectangular section, and both damping assemblies with metal windings are arranged symmetrically on two sides of the container, whilst the two sets of two strips are symmetrically arranged on the two other sides of the container.

16. Vessel according to claim 1, wherein the set-point break strips are inclined in the direction of the axis of the container.

17. Vessel according to claim 16, wherein the set-point damping means include at least two sets of two strips, arranged symmetrically on either side of the container.

18. Vessel according to claim 17, wherein the container has a rectangular section, and both damping assemblies with metal windings are arranged symmetrically on two sides of the container, whilst the two sets of two strips are symmetrically arranged on the two other sides of the container.

* * * * *